United States Patent [19]

Jameson

[11] Patent Number: 4,938,865

[45] Date of Patent: Jul. 3, 1990

[54] COLUMN FLOTATION METHOD AND APPARATUS

[75] Inventor: Graeme J. Jameson, New Lambton, Australia

[73] Assignee: University of Newcastle Research Assoc., Ltd., Australia

[21] Appl. No.: 100,956

[22] Filed: Sep. 25, 1987

[30] Foreign Application Priority Data

Sep. 25, 1986 [AU] Australia ..... PH08216

[51] Int. Cl.[5] ..... B03D 1/14; B03D 1/24

[52] U.S. Cl. ..... 209/168; 209/170; 209/164

[58] Field of Search ..... 209/164, 168, 169, 170; 210/221.2, 703

[56] References Cited

U.S. PATENT DOCUMENTS

| | | | |
|---|---|---|---|
| 1,124,855 | 1/1915 | Callow et al. | 209/170 |
| 1,333,712 | 3/1920 | Groch | 209/170 |
| 1,470,350 | 10/1923 | Court | 209/170 |
| 2,758,714 | 8/1956 | Hollingworth | 209/170 |
| 3,255,882 | 6/1966 | McCarty | 209/170 |
| 4,220,612 | 9/1980 | Degner | 209/170 |
| 4,226,706 | 10/1980 | Degner | 209/170 |
| 4,431,531 | 2/1984 | Hollingsworth | 209/170 |
| 4,477,341 | 10/1984 | Schweiss | 209/170 |
| 4,534,862 | 8/1985 | Zlokarnik | 209/170 |
| 4,726,897 | 2/1988 | Schweiss | 209/170 |

FOREIGN PATENT DOCUMENTS

| | | | |
|---|---|---|---|
| 663614 | 5/1963 | Canada | 209/170 |
| 513723 | 7/1976 | U.S.S.R. | 209/164 |
| 662150 | 5/1979 | U.S.S.R. | 209/164 |
| 663433 | 5/1979 | U.S.S.R. | 209/164 |
| 740284 | 6/1980 | U.S.S.R. | 209/164 |

OTHER PUBLICATIONS

Hackh's Chemical Dictionary, 4th Edition, copyright 1969, McGraw-Hill Books, p. 275, "Foam".

*Primary Examiner*—David L. Lacey
*Assistant Examiner*—Thomas A. Lithgow
*Attorney, Agent, or Firm*—Ostrolenk, Faber, Gerb & Soffen

[57] ABSTRACT

A method and apparatus for the benefication of mineral ores by the flotation method whereby a slurry is introduced under pressure into the top of a first column through a downwardly facing nozzle, and air is entrained into the slurry forming a downwardly moving foam bed in the first column. The foam bed passes from the bottom of the first column into a second column where the froth and liquid separate, the froth carrying the values floating upwardly and over a weir and the liquid being drained with the gangue. The liquid/froth interface level in the second column is kept above the bottom of the first column, and the air flow rate into the top of the first column is controlled to keep the first column substantially full of foam.

3 Claims, 1 Drawing Sheet

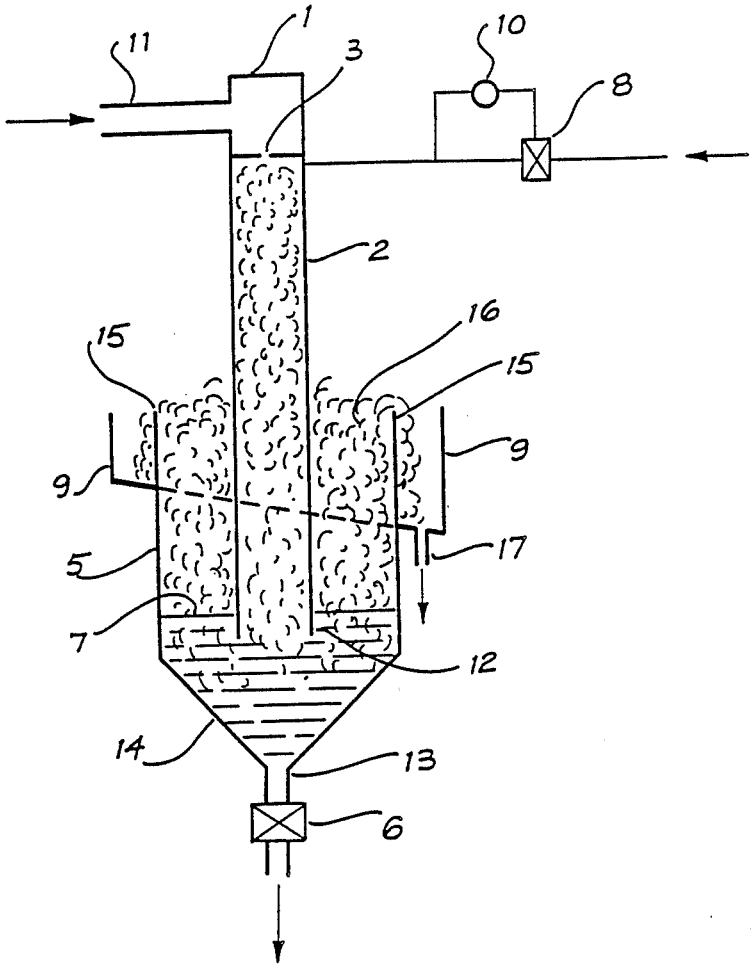
1
2
3
5
6
7
8
9
9
10
11
12
13
14
15
15
16
17

COLUMN FLOTATION METHOD AND APPARATUS

This invention relates to an improved flotation method and apparatus and more particularly to column flotation for the beneficiation of mineral ores and the like.

BACKGROUND OF THE INVENTION

Flotation is a known process for the separation of particulate materials from slurries or suspensions in a liquid, usually water. The particles which it is desired to remove from the suspension are treated with reagents to render them hydrophobic or water repellent, and a gas, usually air, is admitted to the suspension in the form of small bubbles. The hydrophobic particles come into contact with the bubbles and adhere to them, rising with them to the surface of the liquid to form a froth. The froth containing the floated particles is then removed as the concentrate or product, while any hydrophilic particles are left behind in the liquid phase and pass out as the tailings. The flotation process can be applied to suspensions of minerals in water, and also to the removal of oil droplets or emulsified oil particles, as well as to fibrous or vegetable matter such as paper fibres and bacterial cells and the like.

In most applications it is necessary to add reagents known as collectors which selectively render one or more of the species of suspended particles hydrophobic, thereby assisting in the process of collision and collection by the air bubbles. It is also usual to add frothing agents to assist in the formation of a stable froth on the surface of the liquid. The process of admitting these various reagents to the system is known as conditioning.

In conventional known cells, the contact between the air and the conditioned slurry is effected in a rectangular cell or tank having substantially vertical walls, the contents of the cell being stirred by a mechanical agitator which usually serves the additional purpose of breaking up the supply of air into small bubbles. In another known process described as column flotation, the conditioned suspension is introduced toward the top of a tall vertical column, and air bubbles are formed in the bottom of the column by blowing pressurized air through a diffuser. A layer of froth bearing the floatable particles forms above the liquid and overflows from the top of the column. The liquid containing the non-floating particles discharges from the bottom of the column. The position of the froth-liquid interface is maintained at a desired level by controlling for example the flow of liquid from the bottom of the column.

In some embodiments, wash water is introduced near the top of the froth layer to create a downflow of liquid which tends to reduce the entrainment of undesired gangue particles in the froth overflow.

In such known flotation columns, the liquid flows downward while the bubbles rise vertically upward. Since the rise velocity of the bubbles is related strongly to their size, the bubbles must be above a certain critical diameter in order that they may rise through the liquid and into the froth layer.

This method of operation using counter-current flow of liquid and bubbles possesses several operating difficulties or deficiencies when implemented. Any bubbles smaller than the critical size will be swept down the column and out in the tailings stream, carrying with them any floatable particles which may be adhering to them. Furthermore the necessity to operate with relatively large bubbles, typically in the range 1 to 3 mm in diameter, places a limit on the area of gas-liquid interface that can be created in the column. Since the quantity of particles that can be recovered from the bubbles, it would obviously be desirable to disperse the given quantity of air provided into the finest practicable size in order to give a large surface area and hence maximize the recovery of the particles.

Another disadvantage with known columns is that the proportion of bubbles in the total volume of the liquid phase in the column is relatively low, being typically in the range 10 to 20 percent. Thus the distance between bubbles is relatively large and the probability of contact between particles and bubbles is relatively lower than if the bubbles were very closely packed. A low probability of contact leads to low recovery rates of floatable particles, and to the necessity for very tall columns or a multiplicity of columns to achieve a desired yield.

A further disadvantage is related to the necessity in flotation columns to introduce the air through a diffuser made of porous material containing very fine holes. Such diffusers tend to block or become plugged, not only with fine particles but also from deposits which form by precipitation, especially when the liquid has a high concentration of dissolved solids.

It is the purpose of the present invention to provide a simple, efficient and economic means of conducting the flotation process which overcomes the difficulties inherent in known columns, by creating a stable dispersion of bubbles in the liquid, which bubbles may be as fine as desired without detriment to the process, and which may be present in very high void fractions thereby creating an environment highly favorable to the capture of the floatable particles.

SUMMARY OF THE INVENTION

In one aspect the invention provides a method of separating particulate materials from slurries or suspensions in a liquid, said method comprising the steps of introducing the liquid into the upper part of a first column, entraining air into the liquid forming a downwardly moving foam bed in the first column, passing the liquid and entrained air from the lower part of the first column into a second column, allowing froth from the foam to separate from liquid in the second column forming a liquid-froth interface, removing the froth with entrained particulate materials from the upper part of the second column, and removing remaining liquid from the lower part of the second column.

In a further aspect the invention provides apparatus for separating particulate materials from slurries or suspensions in a liquid, said apparatus comprising a first vertically extending column or chamber having its lower end communicating with a second vertically extending column or chamber, an air supply into the upper part of the first column or chamber, a liquid outlet in the upper part of the first column or chamber adapted to be supplied with the said liquid under pressure so that the liquid issues thereform, entraining air from the air supply and forming a downwardly moving foam bed in the first column or chamber, an overflow weir in the upper part of the second column or chamber located above the lower end of the first column, and a liquid drain in the lower part of the second column adapted to remove liquid separating out from the foam bed.

The separation or flotation process is carried out in two steps. A suspension of finely divided material which has been suitably conditioned with collector and frother reagents, is introduced to the top of a column with a suitable quantity of air. The liquid is preferably injected in the form of one or more jets which point vertically downward and entrain the air, creating a bed of dense foam. The foam bed then flows downward through the column, issuing at its base into an adjoining vertical column where it is permitted to separate into two layers a froth layer containing the floatable particles which rises upward to discharge over a suitably-placed weir; and a liquid layer containing the unfloated gangue particles which then pass through the liquid drain to tailings.

The principle of the invention is therefore to create in the first or contacting column a co-current downward flow of air and liquid containing the suspended particles, in the form of a dense foam of void fraction up to 0.8 approximately, thereby providing an environment highly favorable to the capture of floatable particles at a gas-liquid interface. The second or froth column acts as a relatively quiescent froth reservoir in which excess liquid is permitted to drain downward and out of the chamber in a tailings stream while the product in the form of a relatively dry froth containing the floatable particles, flows out from the top.

The principle differs from known flotation devices in that the contacting between the floatable particles and the gas takes place entirely in the foam bed, and it is not necessary for the successful operation of the device for the air or the dense foam to bubble through a liquid layer. At no stage is air bubbled into a liquid as in conventional agitated floatation cells or floatation columns. The strong mixing action of the liquid jets creates a dense foam instantaneously, which is stabilized by the particles and reagents present and travels in a substantially plug-flow downward through the collection column.

Another unique feature of the invention concerns the relation between the high void fraction and the downward flow in the first column. Under the action of gravity, the bubbles will tend to rise upward in the column. However at the same time the liquid is moving vertically downward. Thus, provided the downward velocity of the liquid exceeds the rise velocity of the bubble swarm, a stable operation is possible with a net downward motion of the total foam bed. Because of the crowding effect of the bubbles acting together, the effective rise velocity of the bubble swarm is much less than that of an individual bubble from the swarm rising alone in the liquid. Accordingly it is possible to operate the first column with a relatively low downward liquid superficial velocity, to create a dense liquid foam containing up to 80 percent by volume of gas bubbles whose size depends on the operating conditions but which are typically less than 0.5 mm in diameter.

Because of the high void fraction and the small diameter of the bubbles, the liquid films between the bubbles are very thin and are indeed of the same order of magnitude in thickness as the size of typical floatable particles. Thus the particles do not have to move far before coming into contact with an interface and hence forming an attachment with a bubble.

The environment in the first or collection column is particularly favorable for the efficient recovery of floatable particles, not only because of the high void fractions but also because of the high gas-to-liquid flow rate ratios at which the column can be operated. Thus volumetric ratios of gas to liquid of as high as four to one can conveniently be obtained.

In the second or froth column, a net counterflow of gas and liquid exists. The liquid drains under gravity leaving a relatively dry froth to discharge at the top of the column carrying the floatable particles. It is convenient to maintain a pool or reservoir of the drained liquid in the bottom of the froth column, and a relatively sharp interface develops between the froth and the drained liquid. The height of this interface can be controlled to a desired level by suitable means.

DESCRIPTION OF THE DRAWING

Notwithstanding any other forms that may fail within its scope, one preferred form of the invention will now be described by way of example only with reference to the accompanying drawing which is a diagrammatic cross sectional elevation of one form of flotation cell according to the invention.

DESCRIPTION OF THE PREFERRED EMBODIMENT

Suitably conditioned feed liquid is introduced through an inlet conduit (11) to a chamber (1) in the top of a first or inner column or downcomer (2), from which it passes through an orifice (3), so that it issues into the top of the first column in the form of a downwardly facing high-speed liquid jet. The jet points vertically downward and falls through the downcomer (2) which is also substantially vertical.

The first column (2) has an open lower end (12) communicating with the lower region of a second vessel or column (5). In the configuration shown in the drawing, the first and second columns are circular in horizontal section and concentric, but it will be appreciated that the columns could be side by side and have other cross sectional areas. The vessel (5) drains to a lower point (13) (e.g. by way of conically tapered lower wall 14) and is provided with a gangue outlet control valve (6). The upper lip (15) of the vessel (5) forms an overflow weir for froth (16) which collects in a launder (9) and is drained away through outlet (17).

In operation, the downcomer (2) becomes filled with a dense froth which travels downward to discharge into the outer vessel (5). The level of liquid in the outer vessel or container is maintained by the valve (6) or other means, at a level (7) which is above the level of the lower end of the downcomer, so forming a hydraulic seal for the downcomer. The hydraulic seal is important, as without it, the forth will not rise substantially in the downcomer.

Air is introduced to the top of the column (2), through a valve (8) operated by a controller (10) and mixes with the incoming feed liquid, so that the downcomer becomes filled with a dense foam of finely-dispersed air bubbles. Thus a very favorable environment is created for contact between the air and the liquid, enabling the floatable particles in the feed to become attached to the air bubbles.

When the dense foam leaves the bottom of the downcomer (2), the air bubbles rise up the annular gap between the two columns in the form of a froth, which carries the floatable particles, and the froth (16) then discharges over the weir (15) into the launder (9). The pulp bearing the gangua or unfloated particles discharges from the bottom of the vessel (5) under the control of the valve (6).

When the operation of the device is first commenced, there is no liquid in the system. The valve (8) is closed so that no air is admitted to the first column. The flow of feed liquid to the first column is commenced. The valve (6) is closed, so that the liquid level gradually rises in the vessel (5), until it reaches the base of the first column (2), and can be stabilized by a suitable control mechanism (not shown) at a general level (7) just above the bottom of the column (2). At this stage, the jet is plunging directly into the free surface of the liquid near the bottom of the first column, and because of the frothers and other conditioning agents in the feed, a froth quickly generates. Air is entrained into the froth by the action of the jet, so the upper surface of the froth quickly rises to fill the first column (2).

Because of the net downward motion of the liquid, there is a tendency for small bubbles to be carried out of the bottom of the column (2), and if no air is admitted, after a period of time most of the air originally in the column will have been carried down and out. Once the froth level in the first column has reached substantially the position of the nozzle (3) however, it is possible to open the valve (8) and admit air. Provided the rate of inflow of air does not exceed the rate at which air is being entrained into the froth by the jet, the froth level will remain at or near the point of entry of the liquid jet. Under these conditions, the whole column (2) remains filled with a dense downwardly moving froth bed.

Although the apparatus has been described in relation to a liquid distribution device containing only one orifice or nozzle (3), the invention applies also where there is a multiplicity of orifices, nozzles or slits, of fixed or variable area, through which the liquid may flow. In fact, any method of dispersing the air feed into small bubbles may be use, such as a diffuser consisting of a porous plug through which air may be driven under pressure, or a venturi device in which the liquid is forced through a contracting-expanding nozzle and air is admitted in the region of lowest pressure. The liquid jet has the advantage that if large bubbles should form by coalescence of smaller bubbles in the body of the foam bed in the first column (2) and subsequently rise to the top of the column, they can be re-entrained in the jet and become dispersed once more in the foam.

An important consequence of the method of operation described here, is that the hydrostatic pressure inside the first column at the level of entry of the feed through nozzle (3) is lower than the pressure at the upper surface of the froth (16) as it discharges into the concentrate launder (9). Thus if, as is customary, the froth concentrate discharge is open to the atmosphere, the pressure in the top of the first column will be less than the ambient atmospheric pressure, and air can be inspired directly through the valve (8), obviating the need for an air compressor or blower to provide a pressurized air supply. This is a considerable advantage over known flotation columns.

The fact that the pressure in the top of the first column (2) is below the external pressure when the froth column is properly established, can be used to control the operation. Thus it is convenient to link a pressure-actuated controller (10) to the air control valve (8) in such a way that if the pressure inside the top of the first column (2) drops below a predetermined value as sensed by a sensor connected to the controller, the valve (8) is caused to close partially or completely, resulting in the re-establishment of the full bed of dense foam.

It is important to note that the air is entrained into the dense foam bed itself, not the liquid in the vessel (5) as is the normal practice in known types of floation apparatus.

Although the description above refers to air being introduced through valve (8), it will be appreciated that other gases could be used for the flotation method. An example of the operation of one particular apparatus constructed according to the invention will now be described.

A column was constructed according to the principles shown in the attached drawing. The active parts of each of the first and second columns were right cylinders and the first column was mounted inside the second column, which has a conical bottom. The relevant dimensions are as follows:

| | |
|---|---|
| Diameter of first column | 100 mm |
| Diameter of second column | 500 mm |
| Height of first column | 1200 mm |
| Height of second column (cylindrical section) | 1100 mm |
| Level of bottom of first column below froth overflow weir | 700 mm |
| Liquid level above bottom of first column | 200 mm |
| Feed rate | 90 kg/min |
| Feed density | 1240 kg/cubic meter |
| Air rate | 90 liters/min |
| Number of jets | 3 |
| Jet diameter | 5.5 mm |
| Pressure in air space adjacent jets in first column | −2800 Pa gauge |

A zinc ore was floated using sodium ethyl xanthate as collector and methyl isobutyl carbinol as frother. The feed grate was 30.0% Zn. The recovery was 56.1% and the concentrate grade was 42.1% Zn.

What I claim is:

1. Apparatus for separating particulate materials from slurries or suspensions in a liquid, said apparatus comprising a first vertically extending column having a lower end, a second vertically extending column and the lower end of the first column being located within and communicating with the second vertically extending column; means for supplying air into the upper part of the first column; liquid outlet means in the upper part of the first column for being supplied with the liquid under pressure so that the liquid issues from the liquid outlet means for entraining air from the air supply means and for forming a downwardly moving foam bed in the first column; an overflow weir in the upper part of the second column located above the lower end of the first column, and a liquid drain means in the lower part of the second column for removing liquid separating out from the foam bed; the air supply means comprising an air flow control valve means for regulating the air supplied to the first column; an controller means for controlling the air flow control valve means, the controller means being actuated by an air pressure sensor means arranged for sensing the air pressure adjacent the liquid outlet means.

2. Apparatus as claimed in claim 1, wherein the liquid outlet means comprises a downwardly facing orifice for causing the liquid to issue therefrom into the first column in a downwardly facing jet.

3. Apparatus as claimed in claim 1, wherein the liquid drain means is provided with valve means operable for maintaining the liquid level in the second column above the lower end of the first column.

* * * * *